United States Patent [19]

Freedom et al.

[11] 4,241,477

[45] Dec. 30, 1980

[54] PAPER CLIP

[76] Inventors: John Freedom; Thomas Freedom, both of 17100 Harlem Ave., Tinley Park, Ill. 60477

[21] Appl. No.: 67,200

[22] Filed: Aug. 16, 1979

[51] Int. Cl.[3] ..... B42F 3/00

[52] U.S. Cl. ..... 24/67 R; 24/67 P; 24/67.3; 24/67.9; 281/15 B

[58] Field of Search ..... 24/67 R, 67 P, 67.3, 24/67.5, 67.7, 67.9, 67.11, 11 F; 248/309 A, 451, 452; 211/45; 281/15 R, 15 A, 15 B

[56] References Cited

U.S. PATENT DOCUMENTS

| | | | |
|---|---|---|---|
| 457,783 | 8/1891 | Kohnle | 24/67 P |
| 1,218,276 | 3/1917 | Klein | 24/67.7 |
| 1,976,747 | 10/1934 | Reuter et al. | 24/67.3 |
| 2,363,355 | 11/1944 | Pitt | 24/67.3 |
| 2,563,709 | 8/1951 | Ehrler | 281/15 B |
| 2,730,781 | 1/1956 | Alunas | 24/67.9 |
| 3,296,673 | 1/1967 | Kirkpatrick | 24/67 R |
| 3,638,282 | 2/1972 | Larsson | 24/67.3 |
| 3,968,546 | 7/1976 | Seaborn et al. | 24/67.11 |

FOREIGN PATENT DOCUMENTS

| | | | |
|---|---|---|---|
| 892891 | 5/1944 | France | 24/67 R |

*Primary Examiner*—Victor N. Sakran

[57] ABSTRACT

There is disclosed an improved paper clip for retaining two or more pieces of paper together formed by a continuous U-shaped body having an upper wall and a lower wall being spaced apart a distance and joined at one end by a junction portion, the upper wall having a cut-out portion formed therein and having one surface thereof including an inclined surface formed therein, spring means mounted on the upper wall and recessed within the cut-out portion the spring means further including an inclined section formed integrally therewith and positioned in cooperating relation with the inclined surface of the cut-out portion such that the inclined section frictionally engages against the inclined surface, the spring means including paper piercing means formed thereon and extending downwardly therefrom in the direction of the lower wall, the spring means constructed to have an open position when retracted and a closed position when depressed, the lower wall having a receiving slot formed therein and positioned in linear alignment with the paper piercing means such that when the spring means is depressed, the paper piercing means will pierce the two or more pieces of paper inserted within the space between the upper and lower wall until the paper piercing means is received in the receiving slot.

9 Claims, 4 Drawing Figures

PAPER CLIP

BACKGROUND OF THE INVENTION

The use of paper clips for clipping and retaining together two or more pieces of paper is quite well known. Indeed, the concept of a paper clip has been in use for some time, and is perhaps a very basic element for retaining two or more pieces of paper together. The currently available paper clip consists of a piece of spring wire which is double bent to form an outer loop and an inner loop, the two loops being in the same planar arrangement such that the natural biasing spring strength of the spring steel will crimp the pieces of paper between when the larger and smaller loops are placed on either sides of the sheets of paper to be clipped.

One of the difficulties which has been noted with regard to the current paper clip is the fact that the spring steel utilized to form the clip may become slightly bent with continued use. When this occurs, the inner and outer loops are no longer in planar juxtiposition with respect to each other, the one loop being out of plane with the other loop. When this occurs, it is obvious that the natural biasing characteristics of the spring steel will not operate to retain the multiple pieces of paper together when the clip is applied thereon. It has become common to observe paper clips falling off of the pieces of paper to be retained together for the reason that the two loops have been bent out of planar arrangement with respect to one another. The obvious impact a damaged clip has is that where important papers are clipped together, should the clip become dislodged, the pieces of paper will go astray and it is quite possible that important documents are either lost, or are not kept in sequential order.

It is believed that an improved paper clip which is simple in construction, easy to manufacture, but nevertheless more accurately insures that the segregated pieces of paper will be clipped together is beneficial. The object of the present invention is therefore, to provide such an improved paper clip.

OBJECTS AND ADVANTAGES

The principal object of the invention is therefore to provide an improved paper clip which is simplified in construction, easy to use, and will assure with a greater degree of accuracy that the pieces of paper to be clipped together will in fact be retained by the clip.

In accordance with the above noted object, it is an object of the present invention to provide an improved paper clip for retaining at least two individual pieces of paper together which is formed by a continuous U-shaped body having an upper wall and a lower wall spaced apart from each other a distance and joined at one end by a junction portion, the upper wall having a cut-out portion formed therein, the cut-out portion having one surface thereof, including an inclined surface formed therein, spring means mounted on the upper wall and recessed within the cut-out portion, the spring means further including an inclined section formed integrally therewith and positioned in cooperating relation with the inclined surface of the cut-out portion such that the inclined section frictionally engages the inclined surface.

The spring means including paper piercing means is formed thereon and extending downwardly therefrom in the direction of the lower wall, the spring means constructed to have an open position when retracted and a closed position when depressed, the lower wall having a receiving slot formed therein and positioned in linear alignment with the paper piercing means such that when the spring means is depressed, the paper piercing means will extend through the open space between the upper wall and lower wall and be received in the receiving slot thereby to securely retain the pieces of paper which are positioned in the open area between the upper and lower wall.

In accordance with the foregoing object, it is yet a further object of the invention to provide an improved paper clip of the type described wherein the spring means is formed by a spring clip including a mounting and mounted on the upper wall, an extension arm extending outwardly from the mounting end of the clip into the cut-out portion of the upper wall and terminating adjacent to the inclined surface of the cut-out portion, an inclined section mounted on and extending upwardly from the extension arm and positioned adjacent to and in frictional contact with the inclined surface of the cut-out portion, a handle section mounted on and extending horizontally outwardly from the inclined section to accommodate the manipulation of the spring means by the user thereof, and paper piercing means carried on the extension arm and extending downwardly therefrom into the area forming the cut-out portion of the upper wall.

In accordance with the prior objects, it is yet a further object to provide an improved paper clip wherein the spring means which includes a mounting end, the extension arm, the inclined section, the handle and the paper piercing means is all formed as a unitary element.

It is yet a further object of the present invention to provide an improved paper clip of the type described wherein the paper piercing means is formed as a conical pin extending downwardly from the extension arm and designed to traverse the open space between the upper wall and lower wall, and to be received in the receiving slot formed in the lower wall and in linear alignment with the conical pin.

In accordance with the foregoing objects, it is yet a further object of the invention to provide an improved paper clip of the type described wherein a further embodiment contemplates the paper piercing means formed as a bifurcated conical pin having a circular slot formed therein adjacent to the terminal end of the pin, and the receiving slot formed in the lower wall being formed as a conical recess having a circular nib formed therein, such that the circular nib engages in the circular slot in the bifurcated pin when the bifurcated pin is depressed within the confines of the conical recess thereby to retain the pin in the closed position by the engagement of the circular nib in the circular slot.

In accordance with all of the foregoing objects, it is yet a further object of the invention to provide an improved paper clip of the type described wherein as one embodiment, the U-shaped body may be formed as a unitary element, and the spring means formed as a second unitary element, and the two fixedly secured together thereby to provide a paper clip of unitary construction but formed of two elements.

A further object of the invention is to provide an additional embodiment of an improved paper clip wherein the U shaped body and the spring means are both formed integrally as a unitary element.

Further features of the invention pertain to the particular arrangement of the parts whereby the above outlined and additional operating features thereof attained.

The invention both as to its organization and method of operation, together with further objects and advantages thereof, will best be understood by reference to the following specification taken in connection with the accompanying drawings.

BRIEF DESCRIPTION OF DRAWINGS

With reference to the drawings, the views shown therein are as follows.

SUMMARY OF THE INVENTION

In summary, the present invention is intended to provide an improved form of a paper clip which will more accurately assure the user thereof that once the pin is inserted over two or more multiple pieces of paper, that the clip will positively pierce and hold those pieces of paper together. In essence, the improved paper clip of the present invention is provided by means of a U-shaped body formed by an upper wall and lower wall having a space therebetween, the upper and lower walls being joined together by a junction portion. The upper wall includes a cut-out portion in which a spring means is mounted, the spring means being mounted to the upper wall and extending laterally into the confines of the cut-out portion by means of an extension arm, the cut-out portion having an inclined surface along one portion thereof, and the extension arm of the spring means having a similar inclined section which cooperates with and frictionally engages with the inclined surface of the cut-out portion, and the spring means further including a handle section extending horizontally laterally from the inclined section to provide a point for manipulating the spring means, the spring means being completed by paper piercing pin formed on the lower portion of the extension arm and extending downwardly therefrom. It will be noted that the lower wall is formed with a receiving slot formed therein to receive the paper piercing pin when the spring means is depressed such that the pin is permitted to pass through the papers which are positioned in the open space between the upper and lower wall and then received into the receiving slot where the same may be frictionally engaged. In this manner, a positive and accurate retention of the paper contained within the open space between the upper and lower walls is achieved.

DETAILED DESCRIPTION OF DRAWINGS

Figure 1:
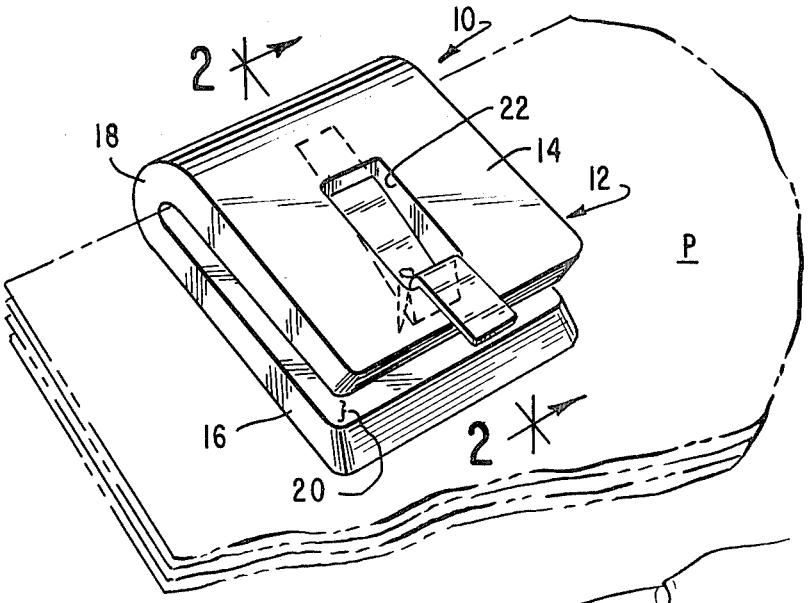
FIG. 1 is a plan view showing the improved paper clip in closed position about a plurality of pieces of paper.

With reference to the drawings, the details of construction of the improved paper clip will be noted. With reference to FIG. 1, the improved paper clip, generally referred to by the numeral 10 is shown to be in position about a series of four sheets of paper (P). With reference of FIGS. 1 through 3 of the drawings, it will be noted that the paper clip is shown to be formed by a U-shaped body 12 including an upper wall 14 and a lower wall 16. The upper wall 14 and lower wall 16 are joined together by a junction portion 18 such that the U-shaped body 12 is effectively formed as a unitary element. It will be observed that the upper wall 14 and lower wall 16 are spaced apart by a distance denoted by the numeral 20 which is of a sufficient distance to permit the insertion therein of multiple pieces of paper. The upper wall 14 is shown to include a cut-out portion 22 which traverses a portion of the upper wall 14. It will be noted that one section of the cut-out portion 22 includes an inclined surface 24 which extends from the upper surface of the upper wall 14 to the lower surface thereof. It will also be noted that the upper wall 14 and lower wall 16 are provided with outer bevelled edges 15 and 17 respectively. The bevelled edges 15 and 17 facilitate the insertion of the paper (P) up to the U-shaped body 12. If desired, the leading edges 15 and 17 may be semi-circular in configuration, again to facilitate the insertion of the paper (P) therein.

Figure 2:
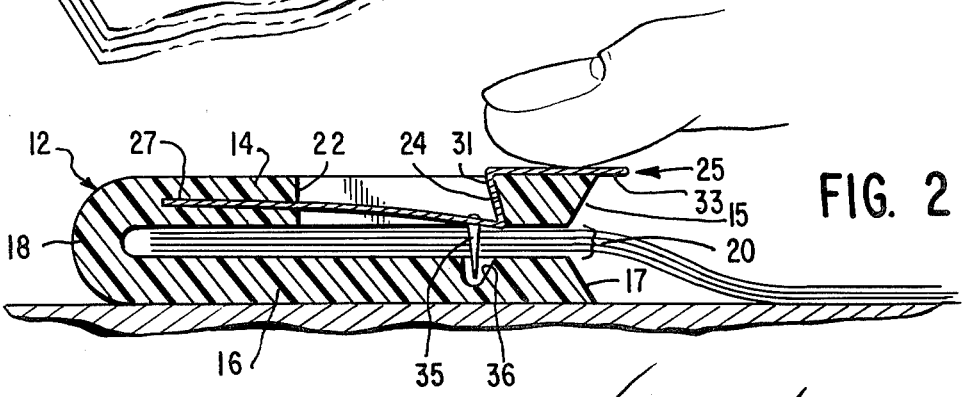
FIG. 2 is a side elevational view, in cross section, taken in the direction of the arrows along the line 2—2 of FIG. 1, showing the details of construction of the U-shaped body and the spring means incorporated therein, with the spring means shown in the closed or depressed position.
Figure 3:
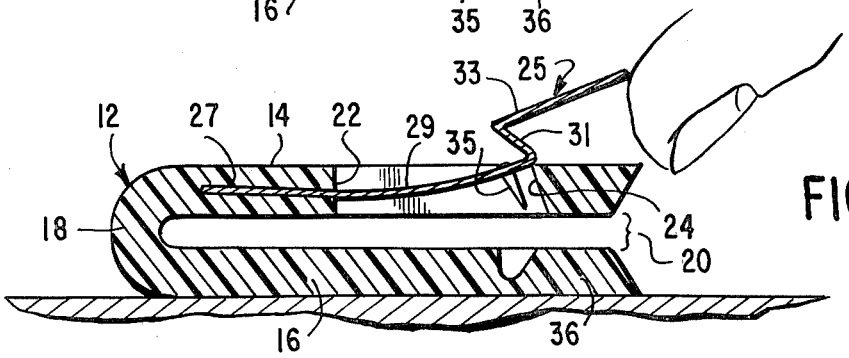
FIG. 3 is a side elevational view in cross section showing the details of construction of the upper and lower walls, and the spring means, and with the paper piercing pin shown in the raised or open position.

With reference to FIGS. 2 and 3 of the drawings, the construction of the spring means associated with the paper clip 10 of the present invention is illustrated. The spring means is generally referred to by the numeral 25 and is generally shown to be formed by a mounting end 27 which in the embodiments illustrated in FIGS. 2 and 3, is shown to be carried within the confines of the upper wall 14. It is contemplated that the mounting of the spring means 25 by mounting the mounting end 27 in the upper wall 14 may be accomplished by either slotting the upper wall 14 to accommodate the insertion of the mounting end 27 therein, or in the event the paper clip 10 is formed out of plastic, the mounting end 27 may be simply molded into the upper wall 14. Various alternative methods of manufacture will be discussed hereinafter.

The spring means 25 is shown to further include an extension arm 29 which extends laterally outwardly from the mounting end 27 and into the confines of the area forming the cut-out portion 22. The extension arm 29 terminates in an inclined section 31 which extends upwardly therefrom. As particularly shown in FIGS. 2 and 3, the inclined section 31 generally is positioned adjacent to and slightly frictionally engages the inclined surface 24 forming a portion of the cut-out portion 22. The spring means 25 is shown to also include a handle portion 33 which extends horizontally outwardly from the inclined section 31. The handle portion 33 may extend outwardly in any direction to accommodate ease of use, or alternatively, the entire spring means 25 may be positioned at a 90° angle as compared to FIGS. 2 and 3 such that the handle portion 33 would be extending laterally along the side of the U-shaped body 12. Finally, the spring means 25 is completed by means of a paper piercing pin 35 which is mounted on the extension arm 29 and extends downwardly therefrom.

Again as shown in FIGS. 2 and 3 of the drawings, FIG. 2 particularly represents the spring means 25 shown in the depressed and closed position with the paper piercing pin 35 extending across the space 20 and inserted through a stack of pieces of paper which are intended to be retained together. FIG. 3, on the other hand, shows the spring means 25 retracted upwardly into the open position such that the pin is carried upwardly into the confines of the cut-out portion 22 such that the space 20 is free and clear of any obstruction. It will be appreciated that in this posture, individual pieces of paper may be inserted or removed at will, so that the paper clip 10 is in a posture for use.

It is contemplated that the spring mechanism 25, depicted in FIG. 2, may be formed such that the normal biasing force of the material together with the inclined positioning of the inclined section 31 locked within the inclined surface 24 will force and retain the spring mechanism 25, in the downward or closed position securely. It is further contemplated that the frictional engagement which takes place between the inclined section 31 vis-a-vis the inclined surface 24, as well as basic configuration of the inclination angle at an angle less than 90°, of surface 24 and section 31, with the horizontal, will not only further assist to hold the spring mechanism 25 in the downwardly closed position, but in fact, it will act as a locking mechanism.

With reference to FIG. 3, when handle 33 of the pinholding spring 25 is pushed in an upwardly direction, the spring 25 will disengage from the closed position. The point of junction of extension arm 29 and inclined section 31 will come to rest and remain in juxta-position to the uppermost surface line of upper wall 14. This posture will occur, since the length of extension arm 29, will be in excess of the length of the upper segment of cut-out portion 22. If such is the case then in order to use the paper clip 10, one merely inserts within the space 20 the intended number of the pieces of paper to be clipped together, and depresses the handle 33 firmly downward. As a result, the inclined section 31, will come to rest along the inclined surface 24 of the cut-out portion 22, and the paper piercing pin 35 will pierce through the papers, creating slight additional friction, and will enter the pin receiving slot 36. In this manner, this slight friction will be added to the downwardly holding force of pin holding spring 25 as defined in detail above. Thus, it will be appreciated that the multiple pieces of paper will remain securely in position within space 20.

For the removal of the pieces of paper, one merely pushes the handle 33 of the pin holding spring 25, in an upwardly direction. The pin will free the papers and remain in the cut-out section 22. Now the pieces of paper can be pulled out at will, leaving the paper clip 10 available for further use.

Figure 4:
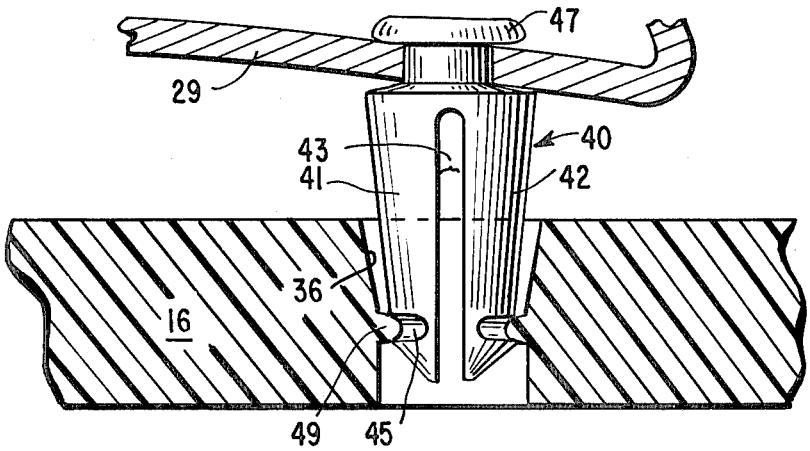
FIG. 4 is a side elevational view, in cross section, showing the details of construction of an additional embodiment of the paper piercing pin formed as a bifurcated pin, and including a circular slot which cooperates with a circular nib formed in the pin receiving recess.

With reference to FIG. 4 of the drawings, an alternate embodiment of the construction of the paper piercing pin vis-a-vis a corresponding receiving slot is illustrated. If desired, the paper piercing pin 40 may be formed as a bifurcated pin having arms 41 and 42 respectively with a space 43 therebetween. Adjacent to lower portion of the pin 40 is a curcular slot 45 which is located adjacent to the lower end of the pin. It will also be noticed in this embodiment that the pin 40 is retained to the extension arm 29 by means of a pin rivet head 47.

It will also be noticed that the lower wall 16 includes a pin receiving slot 36 which in this embodiment is shown to further include a circular nib 49 circumferencially disposed thereabout. It will be appreciated that as the pin 40 is depressed downwardly and pierces the multiple pieces of paper carried in the open space 20 between the upper wall 14 and the lower wall 16, that pin will enter into the pin receiving slot 36 until the circular slot 45 of the pin is in registry with the circular nib 49 of the pin receiving slot 36. In this posture, a locking engagement is achieved such as to insure the accurate and positive locking of pin 40 in position within the confines of the pin receiving slot 36.

It will also be appreciated that various modifications may be made in terms of the construction of the paper piercing pin vis-a-vis the construction of the pin receiving slot. The important aspect of the invention is to insure that the pin will pierce the paper and enter the pin receiving slot such that the multiple pieces of paper pinned together will remain pinned together. In this embodiment, the receiving slot would simply be open and traverse the lower wall 16 completely. It will therefore be appreciated that various mechanical modifications may be made in terms of structure in order to achieve a locking engagement of the pin with the pin receiving slot. It is believed that this type of construction is well known in the art. The present specification and drawings illustrate merely two means for achieving the engagement of the pin with the pin receiving slot which include a mere engagement as in FIGS. 2 and 3 or a locking nib and slot arrangement as in FIG. 4. However, it is contemplated that other forms of engagement are similarly contemplated within the purview of the present invention.

It will also be appreciated that in terms of the structure of the paper clip 10, that the clip may be made of various materials. Obviously, it is contemplated that the preferred material be plastic since it is believed that a mold can be easily constructed which would permit ease of manufacture by simply molding the clip as a unitary element. In this connection, it is contemplated that a mold can be constructed which would mold the entire paper clip 10 as a unitary element, including the U-shaped body 12, as well as the spring means 25. In that event, it will be appreciated that all of the elements will be formed of plastic, including the U-shaped body 12, and the spring means 25, including the paper piercing pin 35. Alternatively, the U-shaped body 12 may be formed of spring steel or other biasing material. In such an event, it would be necessary that the spring means 25 be fixedly secured to the U-shaped body 12 by any appropriate means. This could be accomplished by molding the U-shaped body 12 as a unitary element but wherein a slot is formed in the upper wall 14 thereof. The spring means 25 could then be inserted in the slot and held in position by an adhesive or other similar means. However, it is believed that this type of construction would result in an increase in cost and therefore, would unnecessarily raise the price of the pin on the retail market. Hence, it is believed that the preferred embodiment would contemplate a unitary paper clip 10 formed as a unitary element including the U-shaped body 12 as well as the spring means 25 including the paper piercing pin 35.

It will be appreciated that by virtue of the present invention, an improved paper clip has been provided which is simple in construction, permits ease of manufacture, and yet more surely and positively insures that the multiple pieces of paper which are to be pinned together are in fact retained together once the clip is applied. It will be appreciated that all of the above objects and advantages have been accomplished by virtue of the present invention and the various embodiments depicted therein and contemplated hereby.

While there has been described what is at present considered to be the preferred embodiments of the invention, it will be understood that various modifications may be made herein and it is intended to cover in the appended claims all such modifications as fall within the true spirit of the invention.

We claim:

1. An improved paper clip for retaining at least two individual pieces of paper, together, comprising in combination a continuous U-shaped body having an upper wall and a lower wall spaced apart a distance and joined at one end by a junction portion, said upper wall having a cut-out portion formed therein, said cut-out portion having one surface thereof having an inclined surface formed therein, spring means mounted on said upper wall and recessed within said cut-out portion, said spring means further including an inclined section formed integrally therewith and positioned in cooperating relation with said inclined surface of said cut-out portion such that said inclined section frictionally engages said inclined surface, said spring means including paper piercing means formed thereon and extending downwardly therefrom in the direction of said lower wall, said spring means constructed to have an open position when retracted with said paper piercing means raised upwardly into said cut out portion, and a closed position when said spring means with said paper piercing means depressed downwardly such that said paper piercing means extends across the open space between said upper and lower walls respectively, said lower wall having a receiving slot formed therein and positioned in linear alignment with said paper piercing means when in the depressed and closed position, said receiving slot being dimensionally sized to frictionally receive said paper piercing means when inserted therein, whereby said paper clip may be operated to retain two or more pieces of paper together by simply inserting said pieces of paper into the open space between said upper wall and lower wall, and depressing said spring means such that said paper piercing means extends across said open space between said upper and lower wall, through the pieces of paper positioned therein, until said paper piercing means is received in said receiving slot and frictionally engaged therein, and the paper clip being designed to be removable by simply retracting said spring means into an upper open position thereby to remove said paper piercing means from engaging relationship with the pieces of paper positioned in the open space between said upper wall and lower wall respectively.

2. The improved paper clip as set forth in claim 1 above, wherein said spring means comprises a spring clip form by a mounting end mounted on said upper wall, an extension arm extending outwardly from said mounting end into said cut-out portion and terminating adjacent to said inclined surface of said cut-out portion, and inclined section mounted on and extending upwardly from said extension arm and positioned adjacent to and in frictional contact with said inclined surface, a handle section mounted on and extending horizontally from said inclined section to accommodate the manipulation of said spring means by the user thereof, and paper piercing means carried on said extension arm and extending downwardly therefrom in the area forming said cut-out portion of said upper wall.

3. The improved paper clip as set forth in claim 2 above, wherein said spring means including said mounting end, extension arm, inclined section, handle and paper piercing means is formed as a unitary element.

4. The improved paper clip as set forth in claim 2 above, wherein said spring means is mounted on said upper wall by being carried within the confines of said upper wall between said cut out portion and said junction portion.

5. The improved paper clip as set forth in claim 2 above, wherein said paper piercing means is formed as a conical pin extending downwardly from said extension arm into the confines forming said cut out portion of said upper wall.

6. The improved paper clip as set forth in claim 5 above, wherein said receiving slot is formed as a conical slot in linear alignment with said conical pin thereby to frictionally receive and engage said conical pin when said spring means is depressed downwardly such that said conical pin extends through the open portion between said upper wall and lower wall, and into said receiving slot.

7. The improved paper clip as set forth in claim 2 above, wherein said paper piercing means comprises a bifurcated conical pin having a circular slot formed therein adjacent to terminal end thereof, and said receiving slot formed in said lower wall as formed as a conical recess having a circular nib formed therein, such that said circular nib engages in said circular slot when said bifurcated pin is depressed within the confines of said conical recess thereby to retain said pin in a closed position.

8. The improved paper clip as set forth in claim 1 above, wherein said U-shaped body is formed as an entire unitary element, and said spring means is formed as a second unitary element, and said spring means is fixedly secured to said U-shaped body.

9. The improved paper clip as set forth in claim 1 above, wherein said U shaped body in said spring means are formed intervally as a unitary element.

* * * * *